US007930848B2

(12) United States Patent
Dye, Jr.

(10) Patent No.: US 7,930,848 B2
(45) Date of Patent: Apr. 26, 2011

(54) MODULAR FIRE CONTROL ASSEMBLY FOR A HANDGUN

(76) Inventor: Mark Dye, Jr., Louisville, TN (US)

( * ) Notice: Subject to any disclaimer, the term of this patent is extended or adjusted under 35 U.S.C. 154(b) by 217 days.

(21) Appl. No.: 12/351,547

(22) Filed: Jan. 9, 2009

(65) Prior Publication Data

US 2009/0178322 A1 Jul. 16, 2009

Related U.S. Application Data

(60) Provisional application No. 61/020,797, filed on Jan. 14, 2008.

(51) Int. Cl.
*F41A 19/12* (2006.01)
*F41A 19/14* (2006.01)

(52) U.S. Cl. ..... 42/69.03; 42/69.01

(58) Field of Classification Search ..... 42/69.01, 42/69.02, 69.03; 89/139, 144, 146
See application file for complete search history.

(56) References Cited

U.S. PATENT DOCUMENTS 984,519 A 2/1911 Browning
3,167,877 A * 2/1965 Juengeling ..... 42/69.03
3,949,508 A * 4/1976 Elkas ..... 42/69.03
6,131,324 A * 10/2000 Jewell ..... 42/69.03
6,722,072 B1 4/2004 McCormick
6,772,548 B1 * 8/2004 Power ..... 42/69.03
7,162,824 B1 1/2007 McCormick

* cited by examiner

*Primary Examiner* — Bret Hayes

(74) *Attorney, Agent, or Firm* — Knox Patents; Thomas A. Kulaga

(57) ABSTRACT

Apparatus for a modular fire control assembly for a firearm. The modular fire control assembly integrates a hammer, a sear, a disconnector, and sear and disconnector springs in a single housing. The force applied by the sear spring is adjustable by a set screw, which enables the sear spring force to be dialed in. The sear spring and set screw are contained in a block in the housing. The sear spring engages a detent that applies spring force to the sear. The sear spring moves in a smooth bore that has a ledge that allows the spring to maintain a minimum force even when the set screw is removed. A self-contained disconnector spring ensures constant spring force on the disconnector regardless of adjustments to the sear spring force. The modular assembly is configured to be received in a lock cavity of the firearm and secured using conventional pins.

23 Claims, 4 Drawing Sheets

MODULAR FIRE CONTROL ASSEMBLY FOR A HANDGUN

CROSS-REFERENCE TO RELATED APPLICATIONS

This application claims the benefit of U.S. Provisional Application No. 61/020,797, filed Jan. 14, 2008.

STATEMENT REGARDING FEDERALLY SPONSORED RESEARCH OR DEVELOPMENT

Not Applicable

BACKGROUND OF THE INVENTION

1. Field of Invention

This invention pertains to a modular fire control assembly for a firearm. More particularly, this invention pertains to a modular assembly that integrates various fire control components into an easily replaceable housing that provides for quick and convenient adjustment of the trigger action.

2. Description of the Related Art

The Model 1911 is a single-action, semiautomatic handgun that was patented by James Browning with U.S. Pat. No. 984,519, issued on Feb. 14, 1911, and titled "Firearm." The 1911 is made of separate components that are designed to be hand-assembled in the field by those with basic training. In particular, the fire control mechanism consists of individual, separate components that are removable from the handgun frame. Those separate fire control mechanism components include the sear, the disconnector, and the hammer. The interaction of these three components and their dimensional configuration are crucial to ensuring proper operation and firing of the gun.

The Model 1911 is not unique in its construction. Other firearms include fire control mechanisms that are made of individual components that work together to discharge the firearm and/or prepare the firearm for another round. These components typically fit inside a lock cavity and are held in place with pins. Examples of other such firearms include the SIG Sauer P210 and the Tokorev handgun.

Firing mechanisms rely upon springs for their operation. For example, the Model 1911 employs a leaf spring with three prongs. One leaf engages the grip safety, a second leaf engages the disconnector, and a third leaf engages the sear. To adjust the spring force for the grip safety, the disconnector, and/or the sear, the associated leaf is bent. The firearm operator often desires to have a particular trigger pull force or weight, such as during a competition where a specific pull weight is desirable. The spring force applied to the disconnector and the sear determines the pull weight and, with a leaf spring, requires experimentation by bending each leaf to obtain the desired result. Bending the leaf spring requires a gun smith to disassemble the firearm, bend at least one leaf on the spring, reassemble the firearm, and test the pull weight. The process is repeated until the desired pull weight is achieved.

Examples of a trigger group module for a firearm are U.S. Pat. No. 6,722,072, issued on Apr. 20, 2004, and titled "Trigger group module for firearms and method for installing a trigger group in a firearm and U.S. Pat. No. 7,162,824, issued on Jan. 16, 2007, and titled "Modular trigger group for firearms and trigger group installation method." The trigger group disclosed in the patents allows for the trigger and associated firing mechanism components to be readily replaced in the firearm without requiring a gunsmith for the replacement.

BRIEF SUMMARY OF THE INVENTION

A disconnector, sear, and hammer are incorporated in a module configured to fit inside a lock cavity of a firearm. The module also includes an adjustable sear spring and a disconnector spring. In this way, the module allows for adjusting the trigger weight without requiring a gunsmith and trial and error to bend the conventional leaf spring. Also, the module allows for the trigger components to be replaced without requiring a gunsmith and without concern of the manufacturing tolerances of the individual components and their precise adjustment during replacement.

According to one embodiment of the present invention, a modular fire control assembly for a handgun is provided. The modular fire control assembly has a housing that contains the sear, the disconnector, and the hammer for a modular assembly that ensures the interaction and dimensional configuration regardless of variations of other components of the gun. The modular fire control assembly also includes a disconnector spring that provides for the trigger return. In one embodiment, the disconnector spring is a coiled torsion spring.

The modular fire control assembly also includes a sear spring that is adjustable. The sear spring is in a sear spring block that is attached to a sidewall of the housing. The block has a bore with a threaded adjustment screw in one end. A detent or ball is positioned at the other end of the bore with the sear spring between the adjustment screw and the detent. The trigger pull weight is determined by the sum of the forces applied by the disconnector spring and the sear spring, as adjusted by the adjustment screw.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

An apparatus for integrating several fire control components into a modular assembly 100 for insertion into the lock cavity of a handgun is disclosed. The modular assembly 100 allows the components to be precision manufactured and assembled without regard to handgun and component tolerances. The modular assembly 100 allows for precise adjustment of the spring forces on the various firing mechanism components without the trial and error of bending a leaf spring.

Figure 1:
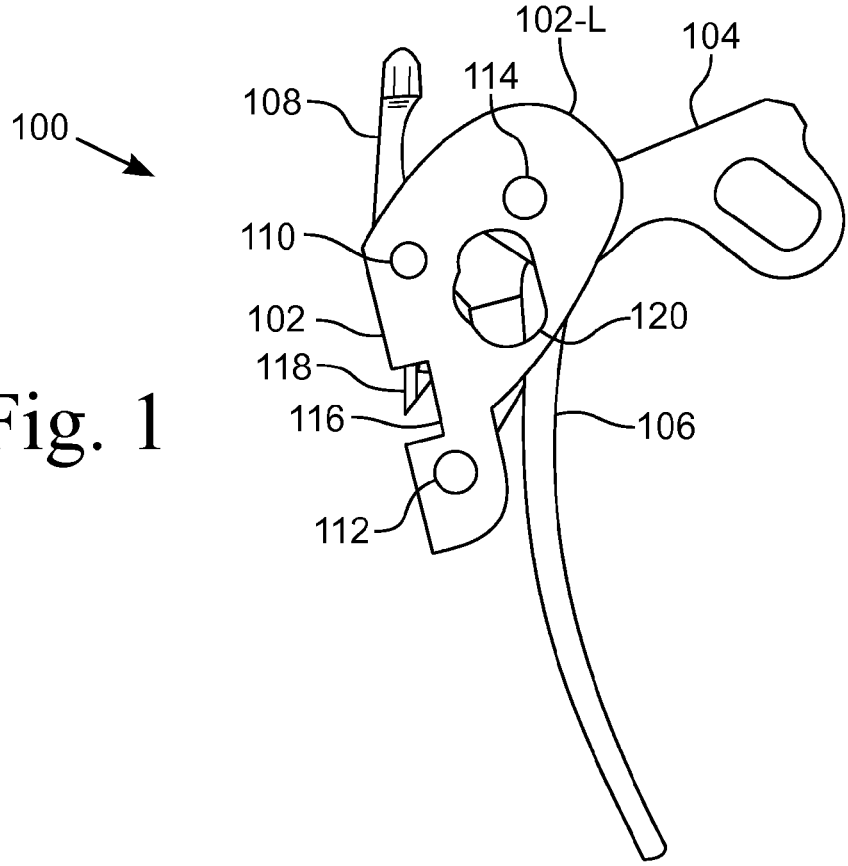
FIG. 1 is a left-side view of one embodiment of a modular fire control assembly.
Figure 2:
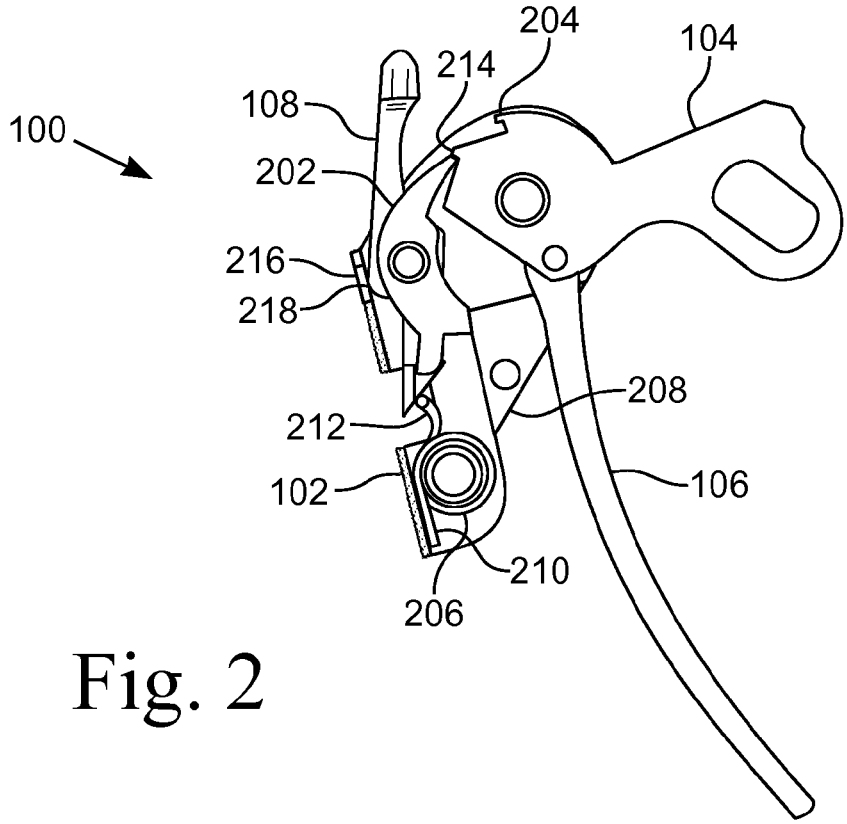
FIG. 2 is a cut-away view of the embodiment of the modular fire control assembly of FIG. 1.

FIG. 1 illustrates a left-side view of one embodiment of a modular fire control assembly 100. FIG. 2 illustrates a cut-away view of the embodiment of the modular fire control assembly 100 of FIG. 1. Directional references with respect to the modular assembly 100, for example, left, right, front, rear, refer to the orientation of the assembly 100 when received in the lock cavity of a receiver frame in a firearm. For a handgun, such as the M1911, the hammer 104 is positioned at the rear of the firearm and the hammer 104 protrudes from the rear of the housing 102.

The left-side panel 102-L of the housing 102 is cut-away for the view of FIG. 2. The left-side panel 102-L includes an opening 120 for receiving the shaft of the thumb safety. The housing 102 also includes a trigger opening 116 through which the trigger bow contacts the paddle 118 of the disconnector 108. The trigger opening 116 has a depth sufficient to allow the trigger bow to move the disconnector paddle 118 to the rear such that the sear 202 disengages the hammer 104.

The modular fire control assembly 100 includes a housing 102. In one embodiment, the housing 102 is sheet metal bent into the illustrated configuration. In other embodiments, the housing 102 is cast or machined. The housing 102 contains a disconnector 108, a sear 202, and a hammer 104. The disconnector 108 and sear 202 pivot about a sear bushing 110, which is a hollow bushing that receives a pin. The hammer 104 pivots about a hammer bushing 114, which is a hollow bushing that receives a pin. The through-openings in the sear bushing 110 and the hammer bushing 114 align with openings in the receiver frame. The modular assembly 100 fits into the lock cavity of the firearm and is held in place with pins inserted through the hollow bushings 110, 114. The pressure of the mainspring against the hammer strut 106 applies a radial force to the sides of the pins and that force tends to retain the pins, and the modular assembly 100, in the receiver. Also, the pressure of the trigger bow against the paddle 118 of the disconnector 108 tends to force the pins to be retained in the receiver. Further, the ends of the pins are retained by the thumb safety. In one embodiment, the bushings 110, 114 are hollow cylinders having a uniform outside diameter. Each end of the cylinder is received and secured in a corresponding hole in the side panels 102-L, 102-R of the housing. In other embodiments, the bushings 110, 114 are hollow cylinders with a smaller diameter step at one or both ends. Each step is received and secured in a corresponding hole in the side panels 102-L, 102-R of the housing. In one embodiment, the housing 102 includes a plate, such as one of the side panels 102-L, 102-R, to which the bushings 110, 114 are attached.

Figure 12:
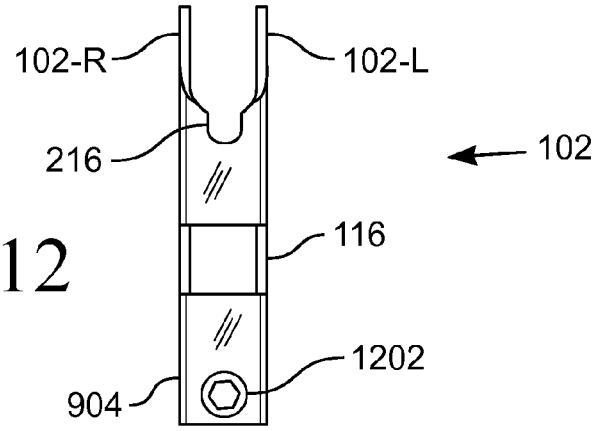
FIG. 12 is a front view of one embodiment of the housing.

A sear spring block 208 is attached to the housing 102. A disconnector spring 206 is held captive by a pin 112 that engages the two panels 102-L, 102-R of the housing 102. The disconnector spring 206 is a helical torsion spring with one end 210 engaging the front wall of the housing 102 and the other end 212 engaging the ramp of the disconnector 108. In various embodiments, the disconnector spring 206 is a single coil or a double coil torsion spring. The disconnector spring 206 forces the paddle 118 of the disconnector 108 toward the trigger and forces the disconnector 108 upwards toward the slide. The disconnector spring 206 has a selected spring force that contributes to the trigger pull weight. In one embodiment, as illustrated in FIG. 12, the front wall of the housing 102 has a threaded opening that receives a setscrew 1202 that pushes one end 210 of the disconnector spring 206 away from the housing 102, thereby allowing a minor adjustment of the force applied by the disconnector spring 206.

Attached to the hammer 104 is a hammer strut 106. The hammer strut 106 is pivoted counter-clockwise in FIG. 2 to better expose the sear spring block 208. The hammer 104 includes a half-cocked hook 204 and a full-cocked hook 214. The hooks 204, 214 engage the sear 202. When the firearm is triggered, the face of the sear 202 disengages the full-cocked hook 214, allowing the hammer 104 to rotate because of the force applied by the hammer strut 106 from the mainspring. To ensure the optimum trigger operation of a handgun, the face of the sear 202 and the face of the engaged full-cock ledge 214 must be precisely surfaced and angled.

The sear 202 and hammer 104 have a thickness that is slightly less than the conventional sear and hammer because the panels 102-L, 102-R of the housing 102 must also fit into the receiver frame with the sear 202 and hammer 104. Additionally, the pin openings of the sear 202 and the hammer 104 are sized for the bushings 110, 114 that retain the sear 202 and hammer 104 in the housing 102. In one embodiment, the hammer 104 includes a groove, or channel, that provides clearance for the disconnector 108 when the hammer 104 rotates. With the narrower thickness of the hammer 104, in one such embodiment the disconnector 108 is thinner near the sear bushing 110 and the hammer groove is correspondingly narrower, thereby allowing more contact surface for the sear 202 with the full-cocked hook 214.

In one embodiment, the front wall of the housing 102 includes a threaded opening above the trigger opening 116. The threaded opening receives a setscrew that contacts a front surface of the sear 202. In such an embodiment, the setscrew does not contact the disconnector 108. The setscrew is adjusted to preset the maximum engagement of the sear 202 with the hammer hook 214.

Figure 3:
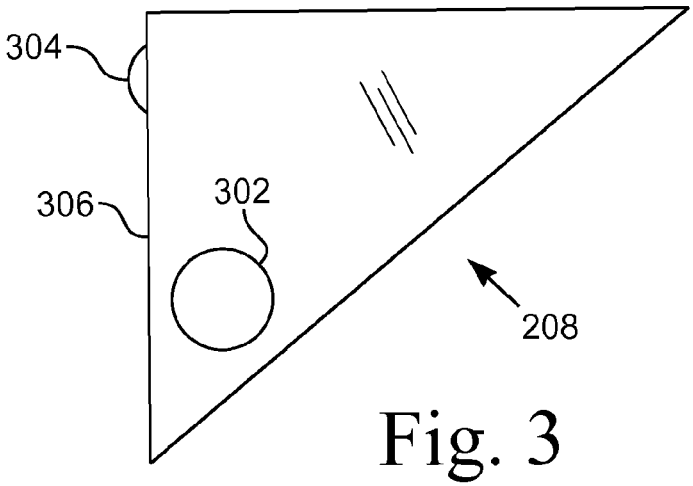
FIG. 3 is a side view of one embodiment of a sear spring block.
Figure 4:
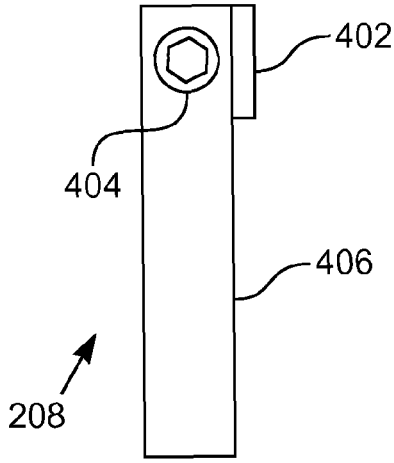
FIG. 4 is a rear view of the sear spring block.
Figure 5:
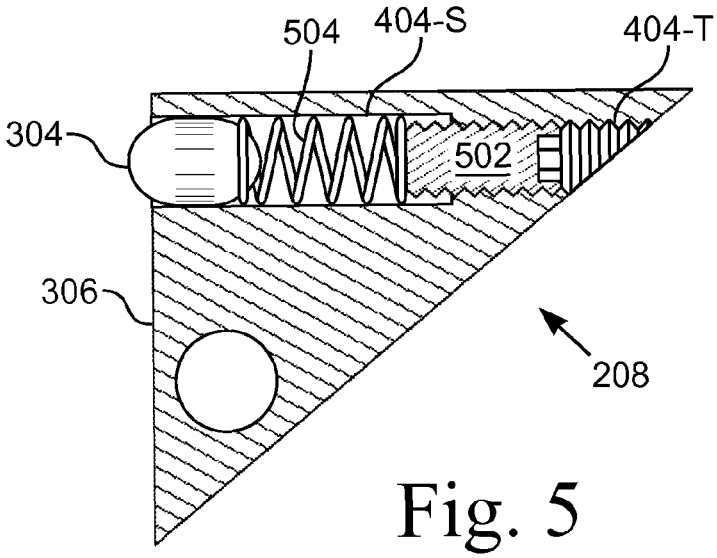
FIG. 5 is a cross-sectional view of the sear spring block.

FIG. 3 illustrates a side view of one embodiment of a sear spring block 208. FIG. 4 illustrates a rear view of the sear spring block 208. FIG. 5 illustrates a cross-sectional view of the sear spring block 208. In various embodiments, the sear spring block 208 has a triangular or other shape dimensioned and configured to fit with the housing 102 while not interfering with any other components in the housing 102.

The sear spring block 208 is positioned below the hammer 104 and against the right-side panel 102-R of the housing 102. In one embodiment, the sear spring block 208 is attached to the right-side panel 102-R with a pin inserted in an opening 302. In other embodiments, the sear spring block 208 is attached to the right-side panel 102-R with one or more spot-welds, rivets, screws, brazed connections, or other fastener that securely holds the sear spring block 208 in a fixed position relative to the housing 102.

The sear spring block 208 includes a bore 404 with two sections: a threaded portion 404-T and a smooth portion 404-S. The threaded portion 404-T contains an adjustment screw 502. The adjustment screw 502, in one embodiment, is a setscrew or other threaded fastener with an inset drive head, such as a socket head. The adjustment screw 502 is linearly positioned along the threaded portion 404-T by rotating the screw 502.

The smooth portion 404-S of the bore 404 contains a sear spring 504 and a detent 304. The sear spring 504 is a compression coil, or helical, spring that slides within the smooth portion 404-S. The detent 304 is a ball or rounded plug that slides within the smooth portion 404-S. The outboard end of the detent 304 engages the lower end of the sear 202 to force the upper end of the sear 202 against the hammer 202. The inboard end of the detent 304 engages one end of the sear spring 504. The opposite end of the sear spring 504 is engaged by one end of the adjustment screw 502. In one embodiment, a lubricant in the smooth portion 404-S ensures that the detent 304 and the sear spring 504 move freely within the smooth portion 404-S without binding. In one embodiment, the smooth portion 404-S and the threaded portion 404-T are joined with a ledge, with the threaded portion 404-T having the smaller diameter. The smooth portion 404-S of the bore 404 has a depth such that the sear spring 504 is retained in the bore 404 if the adjustment screw 502 is backed off such that the screw 502 does not contact the proximal end of the sear spring 504. The depth of the smooth portion 404-S of the bore 404 is a safety feature that ensures that there is always a minimum force applied to the sear 202, even if the adjustment screw 502 were to be backed off or removed entirely from the sear spring block 208. The minimum force applied by the sear spring 502 is sufficient to provide a safe trigger pull under all circumstances.

The sear spring block 208 is positioned within the housing 102 such that the front face 306 of the block 208 engages the lower end of the sear 202 when the sear 202 is in a position that allows the hammer 104 to freely rotate without contacting the sear 202. The lower right-rear of the sear 202 has a flat surface adjacent the front face 306 of the sear spring block 208. The detent 304 engages the flat surface of the lower right-rear of the sear 202. The pressure of the detent 304 against the sear 202 forces the sear 202 to pivot about the sear bushing 110 until the upper tip of the sear 202 engages the hammer hooks 204, 206. The sear spring 504 is compressed by the adjustment screw 502 to adjust the force that the detent 304 applies to the sear 202. The sear spring 504 contributes to the trigger pull weight, and the adjustment screw 502 allows that pull weight to be varied.

Figure 6:
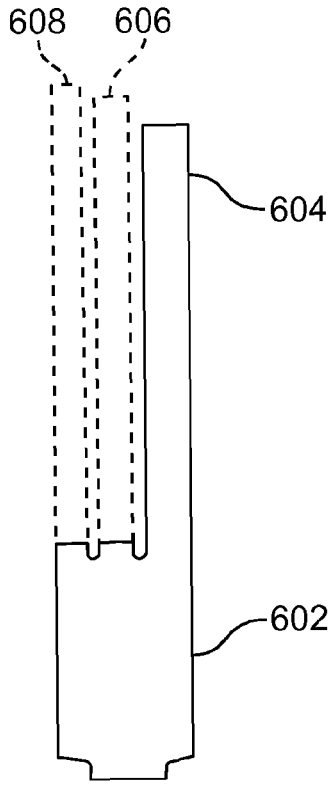
FIG. 6 is a rear view of a grip safety spring.

FIG. 6 illustrates a rear view of a grip safety spring 602. The grip safety spring 602 includes a grip safety leaf 604 that applies spring pressure to the grip safety. The grip safety spring 602 and the dashed lines illustrate a sear spring for a conventional handgun, such as the 1911, when the modular assembly 100 is not used. The sear leaf 608 and the disconnector leaf 606 are not required with the modular assembly 100. In one embodiment, the grip safety spring 602 has the sear leaf 608 and the disconnector leaf 606 removed to eliminate any potential interference with the modular assembly 100.

Figure 7:
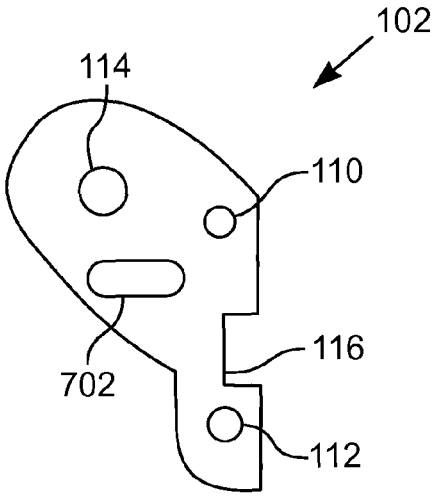
FIG. 7 is a right-side view of one embodiment of a housing.

FIG. 7 illustrates a right-side view of one embodiment of a housing 102. The front of the housing 102 includes a trigger opening 116. The right-side panel 102-R of the housing has openings to engage the sear bushing 110, the hammer bushing 114, and the disconnector spring pin 112. The right-side panel 102-R also includes a slotted opening 702 that receives the pad 402 that protrudes from the right face 406 of the sear spring block 208. In the illustrated embodiment, the pad 402 engagement with the slotted opening 702 aligns the sear spring block 208 in the direction perpendicular to the longitudinal axis of the sear spring 504, and the slotted opening 702 allows the pad 402 to move slightly when it is aligned with the bottom of the sear 202 and before the sear spring block 208 is fixed in position. In another embodiment, the slotted opening 702 is sized such that receives and aligns the pad 402 in a fixed position before the sear spring block 208 is fixed to the housing 102.

Figure 8:
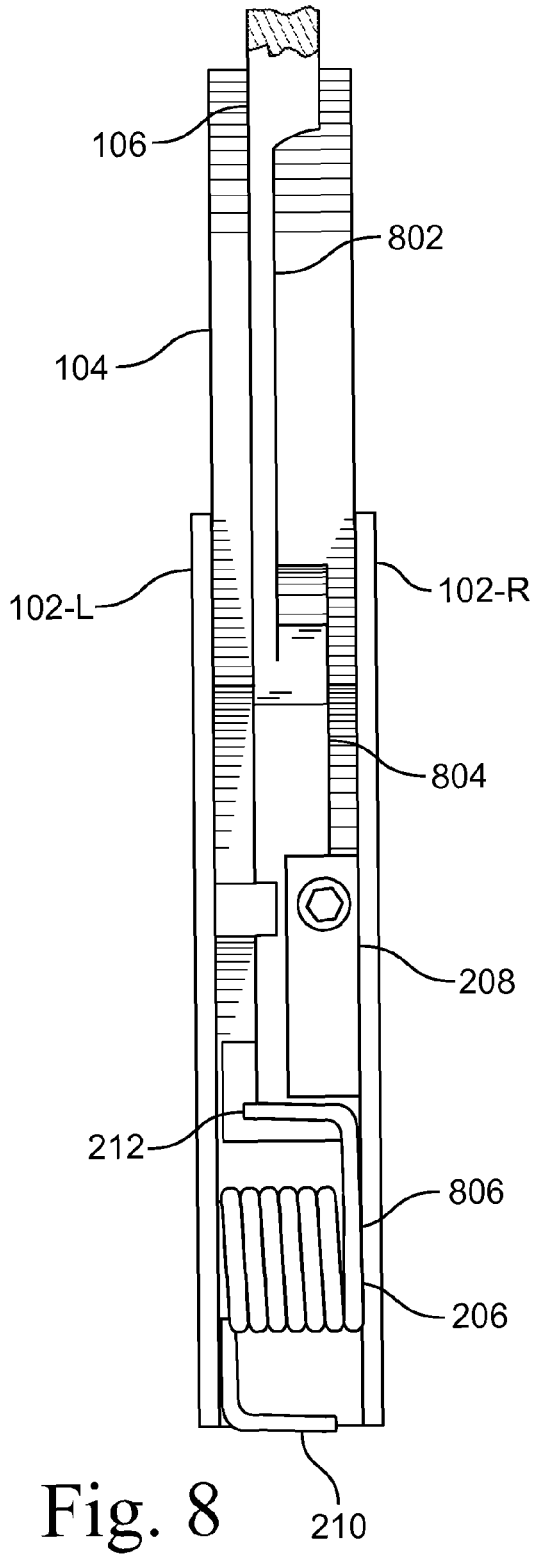
FIG. 8 is a partial rear view of one embodiment of a modular fire control assembly.

FIG. 8 illustrates a partial rear view of one embodiment of a modular fire control assembly 100. In the illustration, the hammer strut 106 is lifted to expose the components in the housing 102. The disconnector spring 206 is a torsion spring with two ends 210, 212. The ends 210, 212 have an L-shaped configuration with one end 210 bearing against the inside front wall of the housing 102. The other end 212 bears against the ramp of the disconnector 108. The spring 206 is selected to have a torsion sufficient to cause the disconnector 108 to operate as desired.

The hammer strut 106 is pinned inside a slot 804 in the hammer 104. The hammer strut 106 has a narrow portion 802 proximate the hammer 104. The narrow portion 802 is dimensioned and configured to provide clearance for the sear spring block 208 as the hammer strut 106 moves when the hammer 104 rotates.

Figure 9:
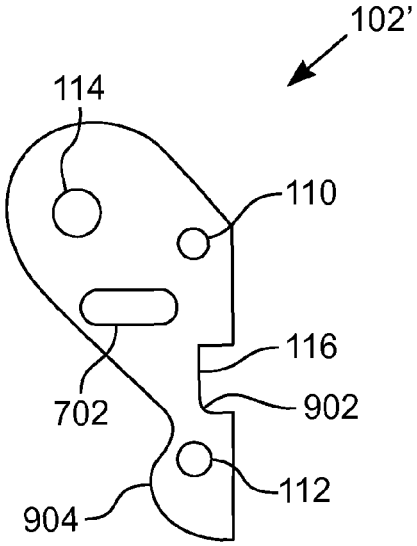
FIG. 9 is a right-side view of another embodiment of the housing.

FIG. 9 illustrates a right-side view of another embodiment of the housing 102'. The illustrated housing 102' is configured for use in other firearms besides the M1911. The bottom 904 of the housing 102' is extended with an arcuate backside. The trigger opening 116 has a lower inside corner 902 that is radiused and is not square-cut. The radiused corner 902 relieves stress in the housing 102', thereby avoiding failure of the housing 102' proximate the extended bottom 904. The trigger opening 116 has sufficient depth to allow the bow of the trigger to engage the disconnector paddle 118.

Figure 10:
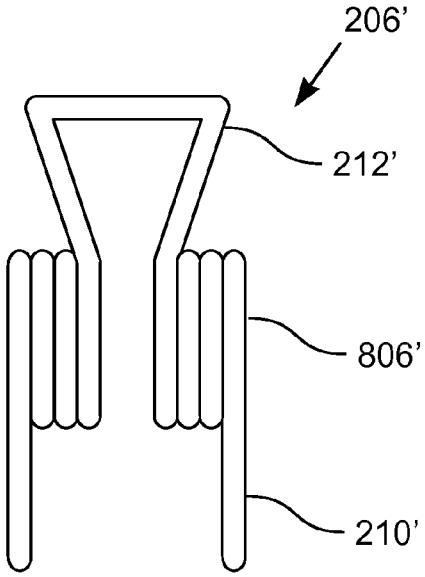
FIG. 10 is a front view of another embodiment of a disconnector spring.
Figure 11:
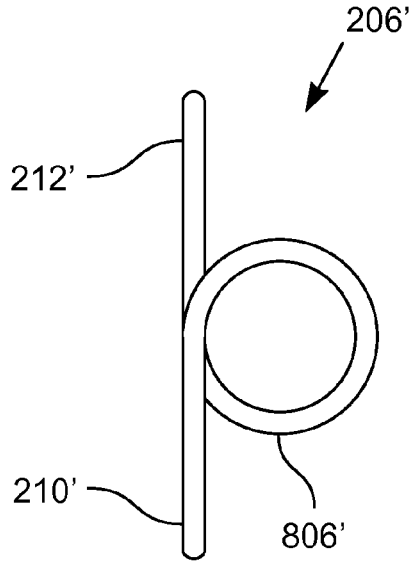
FIG. 11 is a side view of the disconnector spring shown in FIG. 10.

FIG. 10 illustrates a front view of another embodiment of a disconnector spring 206'. FIG. 11 illustrates a side view of the disconnector spring 206' shown in FIG. 10. In the illustrated embodiment, the disconnector spring 206' is a double torsion spring that applies an even pressure to the ramp of the disconnector 108. The double torsion spring 206' has a U-shaped mid-section 212' that engages the ramp of the disconnector 108. The opposite end of the spring 206' has a pair of ends 210' that bear against the inside front wall of the housing 102. The mid-section end 212' of the double torsion spring 206' applies the spring force evenly to the center of the disconnector 108, thereby avoiding applying a torque to the disconnector 108 and avoiding binding of the disconnector 108.

FIG. 12 illustrates a front view of one embodiment of the housing 102. The top portion of the front of the housing 102 includes a notch 216 that provides clearance for the disconnector 108. Referring to FIG. 2, the disconnector 108 has a mid-portion 218 projecting frontward adjacent the sear bushing 110. The mid-portion 218 of the disconnector 108 has a protruding edge to accommodate an opening in the disconnector 108 for the sear bushing 110 to fit. The notch 216 in the housing 102 allows the mid-portion 218 of the disconnector 108, as it moves within the housing 102, to move toward the front of the housing 102 without engaging the front of the housing 102. The notch 216 is dimensioned and positioned such that the disconnector 108 is free to move without the mid-portion 218 of the disconnector 108 striking the front of the housing 102.

A setscrew 1202 is positioned in the front wall of the bottom 904 of the housing 102'. Inside the housing 102' adjacent the setscrew 1202 is one end 210 of the spring 206. Adjustment of the setscrew 1202 moves the end 210 of the spring 206, thereby changing the spring force applied to the disconnector 108.

Figure 13:
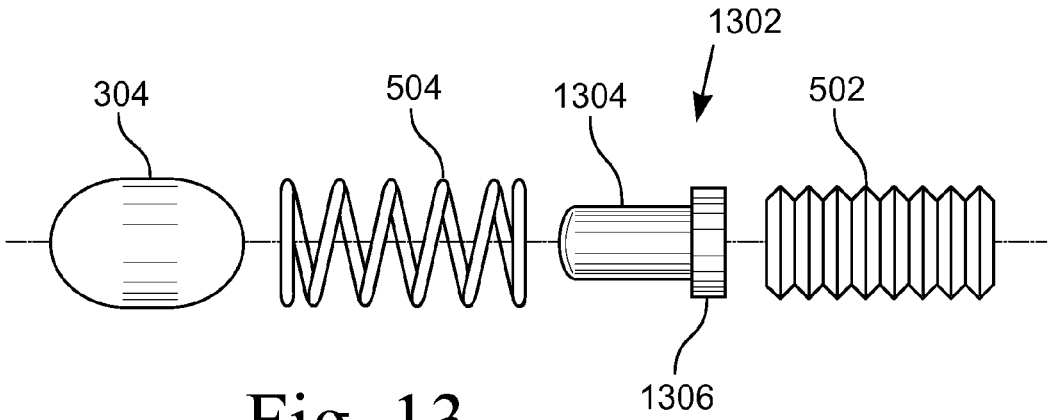
FIG. 13 is an exploded view of another embodiment of the sear spring assembly.

FIG. 13 illustrates an exploded view of another embodiment of the sear spring assembly that fits into the sear spring block 208. A bearing pin 1302 is positioned between the adjustment screw 502 and the sear spring 504. The bearing pin 1302 includes a bearing end 1306 and a pin end 1304.

The bearing end 1306 has a diameter dimensioned to fit inside the smooth portion 404-S of the bore 404. The bearing end 1306 engages the end of the adjustment screw 502 when the screw 502 extends into the smooth portion 404-S of the bore 404 of the sear spring block 208. When the adjustment screw 502 does not extend into the smooth portion 404-S of the bore 404, the bearing end 1306 engages the lip between smooth portion 404-S and the threaded portion 404-T of the bore 404.

The bearing pin 1304 protrudes through the sear spring 504. The bearing pin 1304 has a length sufficient to engage the sear spring 504, but not so long as to shorten the travel of the spring 504 when compressed by movement of the detent 304.

The modular fire control assembly 100 includes various functions. The function of applying a force to the sear 202 is implemented, in one embodiment, by the sear spring 504 contained in a sear spring block 208. The function of adjusting the force applied to the sear 202 is implemented, in one embodiment, by the adjustment screw 502 engaging the sear spring 504 contained in a sear spring block 208.

The function of applying a force to the disconnector 108 is implemented, in one embodiment, by the disconnector spring 206 contained in the housing 102.

The function of controlling the dimensional configuration of the sear 202, the disconnector 108, and the hammer 104 is implemented, in one embodiment, by the housing 102 that supports the sear 202, the disconnector 108, and the hammer 104.

The function of accommodating dimensional differences of different firearms is implemented, in one embodiment, by the housing 102 containing the sear 202, the disconnector 108, and the hammer 104 in a pre-set configuration with the hollow bushings 110, 114 positioned to align with openings in the receiver frame.

From the foregoing description, it will be recognized by those skilled in the art that a modular fire control assembly 100 has been provided. The modular assembly 100 includes a sear 202, a disconnector 108, and a hammer 104 in a pre-set configuration in a housing 102. The housing 102 also includes a disconnector spring 206 that eliminates the need for the disconnector leaf 606. The housing 102 also includes an adjustment screw 502 and a sear spring 504 that eliminates the need for the sear leaf 608.

The modular assembly 100 aids in simplifying the assembly and tear-down of a firearm. The modular assembly 100 also aids in maintaining critical dimensional and configuration relationships between the sear 202, the disconnector 108, and the hammer 104, regardless of manufacturing tolerances of the particular firearm into which the modular assembly 100 is installed. Additionally, the modular assembly 100 aids in increasing the interchangeability of key parts between similar style firearms.

The adjustable sear spring block 208 allows the trigger pull weight to be readily adjusted without requiring complete disassembly of the firearm and experimental bending of the sear leaf 608. With a disconnector spring 206 of a specified or adjustable spring force and the adjustable sear spring block 208, the trigger pull weight of the firearm is precisely controlled. By rotating the adjustment screw 502, the trigger pull weight is adjusted to accommodate changes in trigger pull weight as the firearm is used or as the shooter desires.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An apparatus integrating a fire control assembly for a firearm, said apparatus comprising:

a housing having a first side panel and a second side panel, said first and second side panels joined with a front wall, said front wall having an opening configured to allow entry of a portion of a trigger, said housing dimensioned and configured to be received by a cavity in the firearm;

a hammer pivotably connected to said housing with a first hollow bushing bridging said first and second side panels;

a sear movably connected to said housing with a second hollow bushing bridging said first and second side panels;

a disconnector engaging said sear, said disconnector having a paddle configured for being engaged by said trigger through said opening in said housing;

a disconnector spring held captive in said housing, said disconnector spring having a first end and a second end, said first end engaging said housing, said second end engaging said disconnector; and a sear spring block attached to said housing; said sear spring block having a bore with a threaded portion and a smooth portion, said threaded portion containing a screw, said smooth portion containing a sear spring, said screw engaging said sear spring, said sear spring applying a spring force to said sear.

2. The apparatus of claim 1 further including a hammer strut attached to said hammer, said hammer strut having a narrow portion proximate said hammer, said narrow portion dimensioned and configured to provide clearance for said sear spring block.

3. The apparatus of claim 1 wherein said sear spring block further includes a pad protruding from an outside face of said sear spring block, said pad engaging an aperture in said second side panel of said housing.

4. The apparatus of claim 1 wherein said first side panel of said housing includes an aperture dimensioned and configured to receive a shaft of a thumb safety.

5. The apparatus of claim 1 further including a detent adjacent said sear spring opposite said screw, and said detent bearing against said sear.

6. The apparatus of claim 1 further including a bearing pin in said smooth portion of said bore in said sear spring block; said bearing pin having a portion with one surface adjacent said screw and an opposite surface adjacent said sear spring.

7. The apparatus of claim 1 wherein said threaded portion of said bore in said sear spring block has a diameter less than a diameter of said smooth portion of said bore, said sear spring has a diameter greater than said diameter of said threaded portion, said smooth portion has a length configured to provide a safe trigger pull when said screw is retracted and said sear spring is seated at a ledge between said smooth portion and said threaded portion.

8. An apparatus for a modular fire control assembly for a firearm, the firearm having a sear, a disconnector, and a hammer, said apparatus comprising:

a sear spring having a first end and a second end, said second end configured to cooperate with the sear;

a threaded member;

a block having a bore with a smooth portion and a threaded portion, said threaded member engaging said threaded portion, said sear spring inside said smooth portion, said threaded member engaging said first end of said sear spring when said threaded member is screwed into said threaded portion and extends partially into said smooth portion; and a housing having a plate, said block fixed to said plate, said housing configured and dimensioned to be received by a lock cavity in the firearm;

wherein said threaded portion of said bore in said block has a diameter less than a diameter of said smooth portion of said bore, said sear spring has a diameter greater than said diameter of said threaded portion, said smooth portion has a length configured to provide a safe trigger pull when said threaded member is retracted and said sear spring is seated at a ledge between said smooth portion and said threaded portion.

9. The apparatus of claim 8 further including the sear and the disconnector, which are captive in said housing, and the sear operatively positioned adjacent said block such that said sear spring engages said sear.

10. The apparatus of claim 9 further including a disconnector spring configured to bias the disconnector relative to said plate, and said disconnector spring captive in said housing.

11. The apparatus of claim 9 further including a disconnector spring configured to bias the disconnector, said disconnector spring captive in said housing, and a setscrew engaging a front side of said housing, said setscrew engaging said disconnector spring to vary a spring force applied to the disconnector.

12. The apparatus of claim 8 further including a detent adjacent an end of said sear spring opposite said threaded member, and said detent configured to bear against the sear.

13. The apparatus of claim 8 further including a bearing pin in said smooth portion of said bore in said block; said bearing pin having a portion with one surface adjacent said threaded member and an opposite surface adjacent said sear spring.

14. An apparatus for a modular fire control assembly for a firearm, said apparatus comprising:

a block having a bore with a smooth portion and a threaded portion;

a detent engaging said smooth portion of said bore, said detent having a first end and a second end, said first end of said detent configured to engage a sear in the firearm;

a first spring having a first end and a second end, said first end of said first spring engaging said second end of said detent, said second end of said first spring in said smooth portion of said bore and proximate said threaded portion in said bore; and a threaded member engaging said threaded portion of said bore, said threaded member configured to cause said second end of said first spring to move linearly within said smooth portion when said threaded member is rotated;

wherein said bore has a ledge where said smooth portion joins said threaded portion, said smooth portion having a larger diameter than said threaded portion of said bore, and said first spring having an end proximal said threaded portion, said end slideable only within said smooth portion.

15. The apparatus of claim 14 wherein said smooth portion of said bore has a length sufficient to provide a safe trigger pull when said threaded member is retracted out of said smooth portion of said bore.

16. The apparatus of claim 14 further including a housing with a panel, said block attached to said panel, said sear, a disconnector and a hammer movably connected to said housing, said housing configured and dimensioned to be received by a lock cavity in the firearm.

17. The apparatus of claim 16 wherein said housing further includes a second spring biasing said disconnector relative to said plate, and said second spring captive in said housing.

18. The apparatus of claim 14 further including a bearing member in said smooth portion of said bore in said block; said bearing member having a portion with one surface proximal said threaded portion and an opposite surface proximal said second end of said first spring.

19. An apparatus for a modular fire control assembly for a firearm, said apparatus comprising:

a block having a bore with a smooth portion and a threaded portion;

a detent engaging said smooth portion of said bore, said detent having a first end and a second end, said first end of said detent configured to engage a sear in the firearm;

a first spring having a first end and a second end, said first end of said first spring engaging said second end of said detent, said second end of said first spring in said smooth portion of said bore and proximate said threaded portion in said bore;

a threaded member engaging said threaded portion of said bore, said threaded member configured to cause said second end of said first spring to move linearly within said smooth portion when said threaded member is rotated; and a housing with a panel, said block attached to said panel, said sear, a disconnector and a hammer movably connected to said housing, said housing configured and dimensioned to be received by a lock cavity in the firearm.

20. The apparatus of claim 19 wherein said bore has a ledge where said smooth portion joins said threaded portion, said smooth portion having a larger diameter than said threaded portion of said bore, and said first spring having an end proximal said threaded portion, said end slideable only within said smooth portion.

21. The apparatus of claim 19 wherein said smooth portion of said bore has a length sufficient to provide a safe trigger pull when said threaded member is retracted out of said smooth portion of said bore.

22. The apparatus of claim 19 wherein said housing further includes a second spring biasing said disconnector relative to said plate, and said second spring captive in said housing.

23. The apparatus of claim 19 further including a bearing member in said smooth portion of said bore in said block; said bearing member having a portion with one surface proximal said threaded portion and an opposite surface proximal said second end of said first spring.

* * * * *